US009511301B2

(12) United States Patent
Fukuchi et al.

(10) Patent No.: US 9,511,301 B2
(45) Date of Patent: Dec. 6, 2016

(54) MODEL

(71) Applicant: BANDAI CO., LTD., Tokyo (JP)

(72) Inventors: Hideki Fukuchi, Tokyo (JP); Yuki Sato, Tokyo (JP); Yasuhiro Ishikawa, Tokyo (JP); Yukihide Ide, Tokyo (JP)

(73) Assignee: Bandai Co., Ltd., Tokyo (JP)

( * ) Notice: Subject to any disclaimer, the term of this patent is extended or adjusted under 35 U.S.C. 154(b) by 0 days.

(21) Appl. No.: 14/292,131

(22) Filed: May 30, 2014

(65) Prior Publication Data

US 2015/0321109 A1 Nov. 12, 2015

(30) Foreign Application Priority Data

May 7, 2014 (JP) ..... 2014-096330

(51) Int. Cl.
*A63H 33/00* (2006.01)
*A63H 3/16* (2006.01)
*A63H 3/46* (2006.01)

(52) U.S. Cl.
CPC ..... *A63H 3/46* (2013.01)

(58) Field of Classification Search
CPC ..... A63H 3/46
See application file for complete search history.

(56) References Cited

U.S. PATENT DOCUMENTS 3,699,715 A * 10/1972 Lewis ..... A63H 3/46 446/376
3,731,426 A * 5/1973 Lewis et al. ..... 446/320
4,006,555 A * 2/1977 England et al. ..... 446/219
4,274,224 A * 6/1981 Pugh et al. ..... 446/375
4,680,019 A * 7/1987 Baerenwald et al. ..... 446/378
4,736,417 A 4/1988 Van Dyke
5,257,873 A * 11/1993 Abbat ..... 403/59
5,380,233 A * 1/1995 Numoto ..... 446/92
6,224,456 B1 * 5/2001 Wittenberg ..... 446/330
6,659,315 B2 * 12/2003 Talaric et al. ..... 223/66
6,695,667 B1 * 2/2004 Kee ..... 446/73
6,722,939 B2 * 4/2004 An ..... 446/330

(Continued)

FOREIGN PATENT DOCUMENTS

EP 1099460 A2 5/2001
EP 2108418 A1 10/2009

(Continued)

OTHER PUBLICATIONS

European Patent Office, Extended European Search Report for Application No. 15162638.9, Jun. 22, 2015, 6 pages, Germany.

(Continued)

*Primary Examiner* — Michael Dennis
*Assistant Examiner* — Urszula M Cegielnik
(74) *Attorney, Agent, or Firm* — Alston & Bird LLP

(57) ABSTRACT

A model includes arm parts each including a rotational shaft portion, and a body part including a shaft supporting portion and being connected to and rotatable relative to the arm part. The arm part includes a projecting portion. The body part includes a recessed portion into which the projecting portion is fitted when the rotational shaft portion is inserted into the shaft supporting portion. The rotational shaft portion and the shaft supporting portion include respective locking members that are engageable with each other and limit the movement of the rotational shaft portion in an axial direction within a range between a first position where the projecting portion is fitted in the recessed portion and a second position where the projecting portion is out of the recessed portion.

4 Claims, 6 Drawing Sheets

(56) References Cited

U.S. PATENT DOCUMENTS

| | | | | |
|---|---|---|---|---|
| 2004/0171328 | A1* | 9/2004 | Soviknes et al. | 446/376 |
| 2005/0112993 | A1* | 5/2005 | Cheng | A63H 3/46 446/376 |
| 2011/0097969 | A1* | 4/2011 | deFelice et al. | 446/375 |

FOREIGN PATENT DOCUMENTS

| | | | |
|---|---|---|---|
| EP | 2599408 | A2 | 6/2013 |
| JP | H02-1195 | U | 1/1990 |
| JP | 7-45273 | U | 10/1995 |
| KR | 20100085765 | A | 7/2010 |
| WO | WO 2011/055586 | A1 | 5/2011 |
| WO | WO 2015/170419 | A1 | 11/2015 |

OTHER PUBLICATIONS

International Searching Authority, International Search Report for International Application No. PCT/JP2014/063433, Aug. 12, 2014, 1 pages, Japan Patent Office, Japan.

* cited by examiner

MODEL

CROSS REFERENCES TO RELATED APPLICATIONS

The present application claims priority to Japanese Patent Application No. 2014-096330 filed in the Japan Patent Office on May 7, 2014, the entirety of which is incorporated herein by reference.

BACKGROUND OF THE INVENTION

1. Field of the Invention

The present invention relates to a model.

2. Description of the Related Art

A model includes a first part and a second part that is connected to the first part in such a manner as to be rotatable relative to the first part (see Japanese Examined Utility Model Registration Application Publication No. 7-45273, for example).

Referring to FIG. 7 illustrating the model, which is a model doll, disclosed by Japanese Examined Utility Model Registration Application Publication No. 7-45273, a leg part 10 is connected to a body part 1 in such a manner as to be rotatable relative to the body part 1. The body part 1 includes a projecting member 2 and a spherical member 20 that is fixed to the projecting member 2. The leg part 10 includes a receiving chamber 12 that receives the spherical member 20. A sliding pair of the inner surface of the receiving chamber 12 and the outer surface of the spherical member 20 allows the leg part 10 to rotate.

In the model disclosed by Japanese Examined Utility Model Registration Application Publication No. 7-45273, the leg part 10 that is rotated with the aid of the sliding pair of the inner surface of the receiving chamber 12 and the outer surface of the spherical member 20 is retained at a position taken after the rotation because of the friction that occurs between the inner surface of the receiving chamber 12 and the outer surface of the spherical member 20. However, as the leg part 10 is rotated repeatedly, the inner surface of the receiving chamber 12 and the outer surface of the spherical member 20 are abraded, reducing the force of retaining the leg part 10.

SUMMARY OF THE INVENTION

In one embodiment, a model in which two parts are connected to each other in such a manner as to be rotatable relative to each other and such that a state of the two parts after the rotation is securely retained.

A model according to an aspect of an embodiment includes a first part including a rotational shaft portion, and a second part including a shaft supporting portion into which the rotational shaft portion is inserted. The rotational shaft portion, when inserted into the shaft supporting portion, is supported by the shaft supporting portion in such a manner as to be rotatable and to be movable in an axial direction of the rotational shaft portion. The second part is connected to the first part in such a manner as to be rotatable relative to the first part. One of the first part and the second part includes a projecting portion while the other includes a recessed portion into which the projecting portion is fitted when the rotational shaft portion is inserted into the shaft supporting portion. The rotation of the second part relative to the first part is stopped when the projecting portion is fitted into the recessed portion. The rotational shaft portion and the shaft supporting portion include respective locking members that are engageable with each other. The locking members limit the movement of the rotational shaft portion in the axial direction within a range between a first position where the projecting portion is fitted in the recessed portion and a second position where the projecting portion is out of the recessed portion.

In the above model, the projecting portion may be provided at a base of the rotational shaft portion and may have a polygonal shape that is rotationally symmetrical about a center axis of the rotational shaft portion, and the recessed portion may be provided at an end of an opening provided in the shaft supporting portion and may have the same polygonal shape as the projecting portion.

In the above model, corners of the projecting portion may be chamfered or rounded off.

In the above model, the projecting portion and the recessed portion may each have four or more and six or less corners.

In the above model, the locking member of the rotational shaft portion may be a groove provided annularly along an outer circumference of the rotational shaft portion, and the locking member of the shaft supporting portion may be a projection that is received by the groove.

According to several embodiments of the present invention, the first part and the second part are connected to each other in such a manner as to be rotatable relative to each other and such that a state of the first and second parts after the rotation is securely retained.

DETAILED DESCRIPTION

Figure 1:
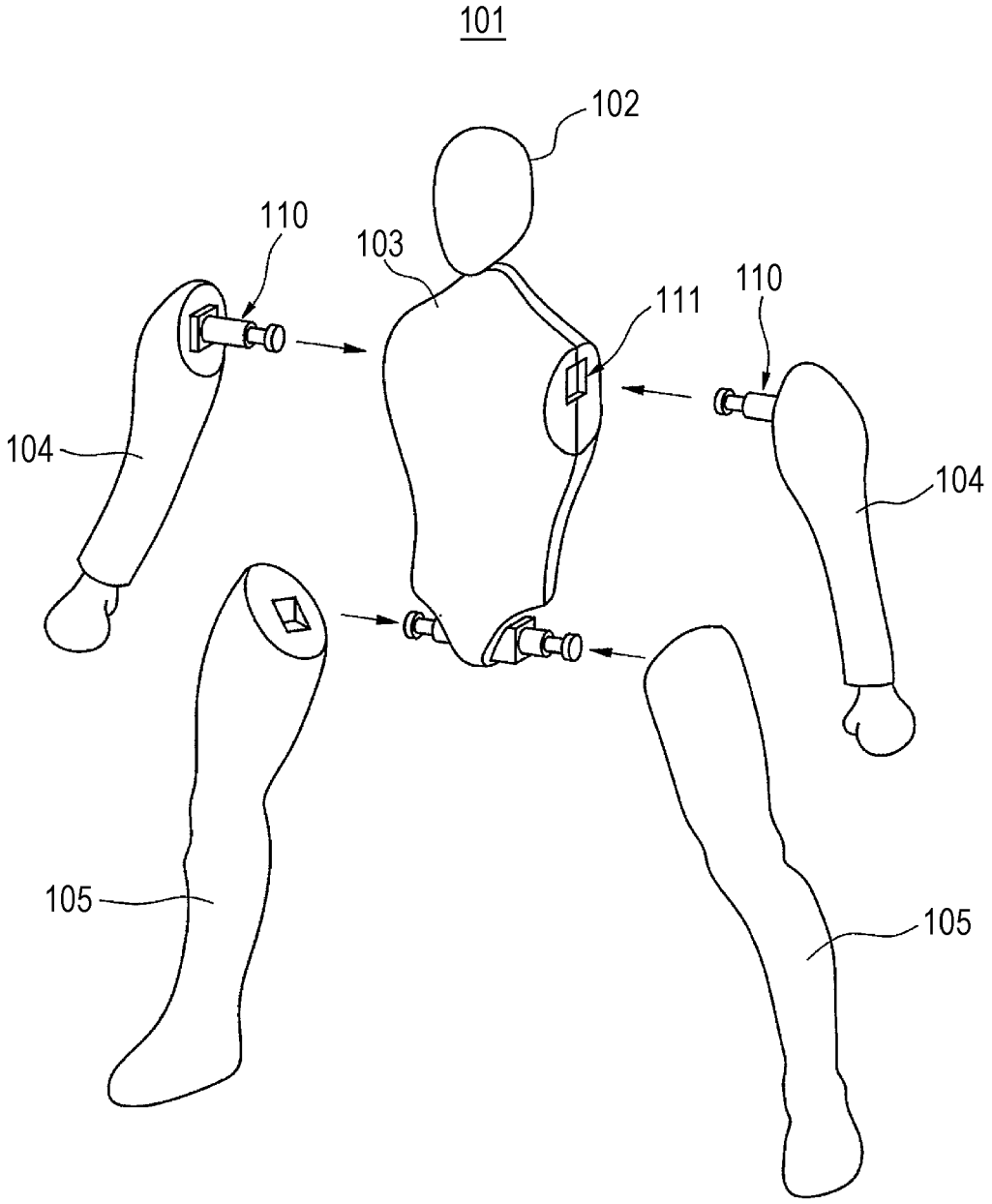
FIG. 1 is an exploded perspective view of an exemplary model according to an embodiment of the present invention.

FIG. 1 is an exploded perspective view of a model 101 according to an embodiment of the present invention.

The model 101 illustrated in FIG. 1 is a doll in its entirety and includes a head part 102, a body part 103, a pair of right and left arm parts 104, and a pair of right and left leg parts 105. The arm parts 104 and the leg parts 105 are each connected to the body part 103 in such a manner as to be rotatable relative to the body part 103.

The embodiment of the present invention will now be described in detail, taking the connection between the body part 103 and each of the arm parts 104 as an example.

Figure 2:
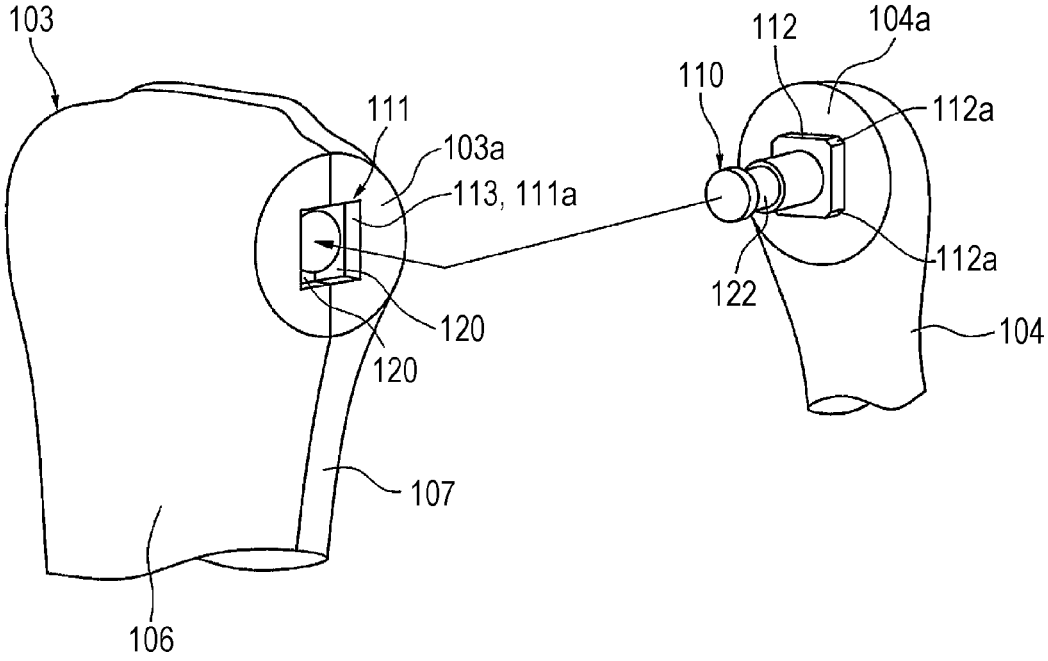
FIG. 2 illustrates a connection portion where a body part and an arm part of the model illustrated in FIG. 1 are connected to each other.
Figure 3:
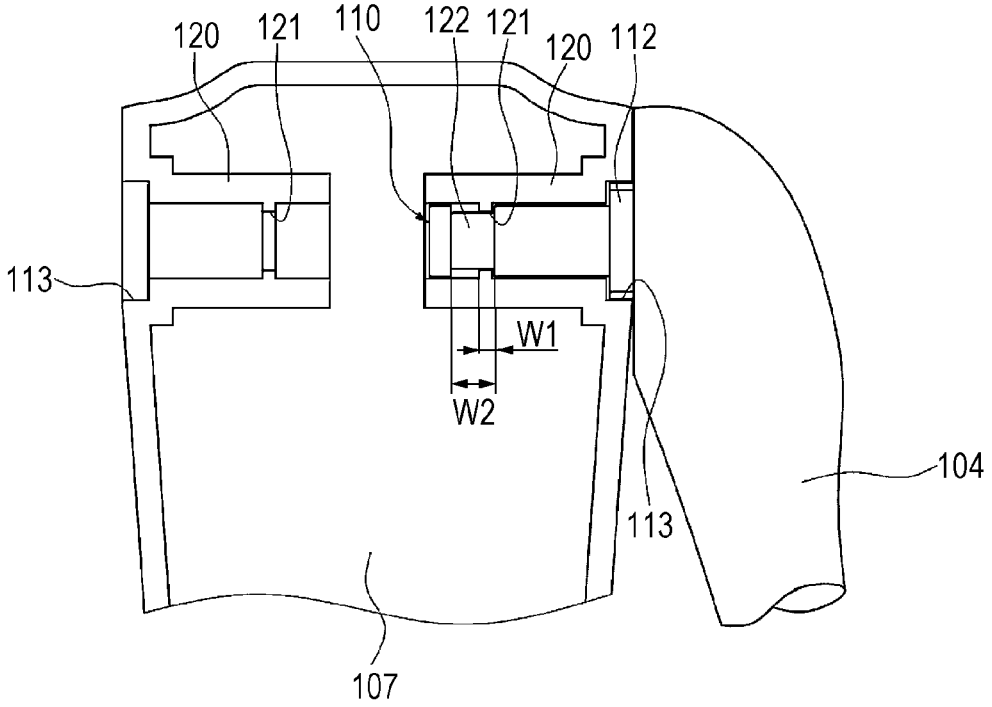
FIG. 3 illustrates an internal configuration of the body part in the connection portion illustrated in FIG. 2.
Figure 4:
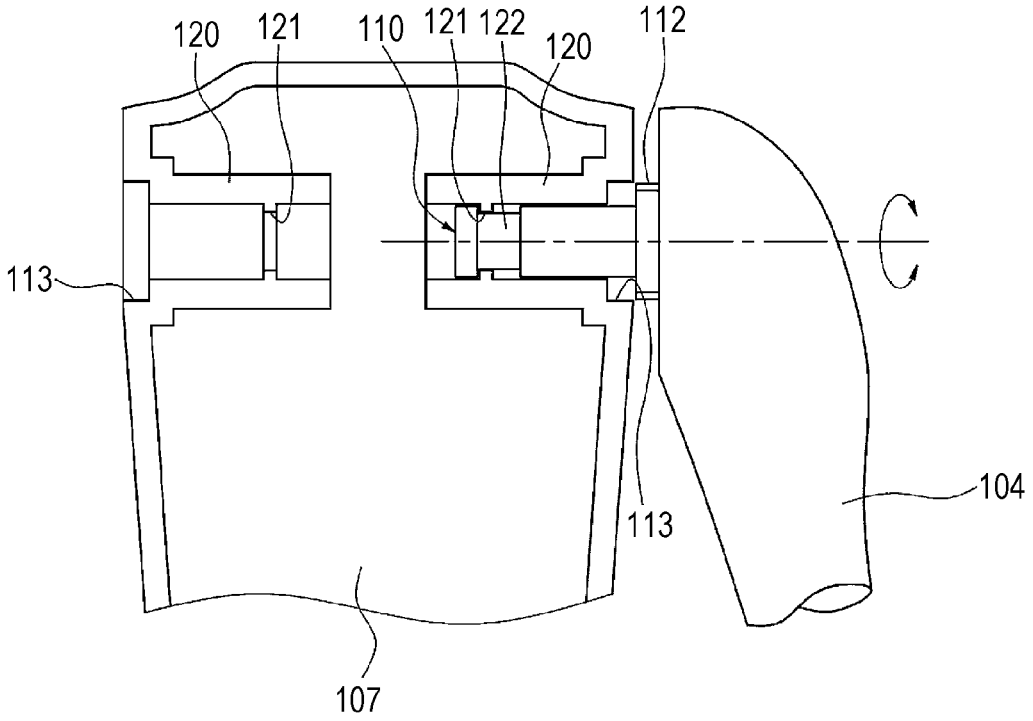
FIG. 4 illustrates the internal configuration of the body part in the connection portion illustrated in FIG. 2.

FIG. 2 illustrates a connection portion where the body part 103 and the arm part 104 are connected to each other. FIGS. 3 and 4 each illustrate an internal configuration of the body part 103 in the connection portion.

The arm part 104 includes a rotational shaft portion 110. The body part 103 includes a shaft supporting portion 111 into which the rotational shaft portion 110 is inserted. The rotational shaft portion 110, when inserted into the shaft supporting portion 111, is supported by the shaft supporting portion 111 in such a manner as to be rotatable and to be movable in the axial direction thereof. It is also acceptable that the body part 103 may include the rotational shaft portion 110 while the arm part 104 may include the shaft supporting portion 111.

The arm part 104 further includes a projecting portion 112. The body part 103 further includes a recessed portion 113 into which the projecting portion 112 is fittable. In the case illustrated in the drawings, the projecting portion 112 is provided at the base of the rotational shaft portion 110, and the recessed portion 113 is provided at an end 111*a* of an opening provided in the shaft supporting portion 111 into which the rotational shaft portion 110 is inserted. The projecting portion 112 and the recessed portion 113 may alternatively be provided separately from the rotational shaft portion 110 and the shaft supporting portion 111 and may be provided on contact surfaces 103*a* and 104*a*, respectively, of the body part 103 and the arm part 104.

The projecting portion 112 provided at the base of the rotational shaft portion 110 has a polygonal shape that is rotationally symmetrical about the center axis of the rotational shaft portion 110. The recessed portion 113 into which the projecting portion 112 is fittable has a polygonal shape that is rotationally symmetrical about the center axis of the shaft supporting portion 111. The polygonal shape of the recessed portion 113 is the same as that of the projecting portion 112. In the case illustrated in the drawings, the projecting portion 112 and the recessed portion 113 each have a square contour.

Corners 112*a* of the projecting portion 112 having a polygonal (square) shape are chamfered or rounded off.

The body part 103 is divided into two pieces, specifically, a first member 106 provided on the front side and a second member 107 provided on the back side. The first member 106 and the second member 107 each include a part of the recessed portion 113. The first member 106 and the second member 107 are joined to each other, thereby forming the body part 103.

As illustrated in FIGS. 3 and 4, the second member 107 includes a supporting wall 120 formed of an inner surface thereof and having a semicylindrical shape. Although not illustrated, the first member 106 likewise includes a supporting wall 120 formed of the inner surface thereof and having a semicylindrical shape. When the first member 106 and the second member 107 are joined to each other, the respective supporting walls 120 of the first member 106 and the second member 107 are integrated into the shaft supporting portion 111.

The supporting wall 120 has a projection 121 on the inner surface thereof. The projection 121 has a semiannular shape and extends in the circumferential direction of the inner surface of the supporting wall 120. Meanwhile, the rotational shaft portion 110 has a groove 122 in the outer circumferential surface thereof. The groove 122 has an annular shape and extends in the circumferential direction of the outer circumferential surface of the rotational shaft portion 110. The groove 122 has a width W2 that is larger than a width W1 of the projection 121. Therefore, the groove 122 is capable of receiving the projection 121.

When the rotational shaft portion 110 is inserted into the shaft supporting portion 111, the projection 121 of the shaft supporting portion 111 is received by the groove 122 of the rotational shaft portion 110, whereby the projection 121 and the groove 122 engage with each other. With the engagement between the projection 121 and the groove 122, the rotational shaft portion 110 is stopped from coming out of the shaft supporting portion 111.

The rotational shaft portion 110 is supported by the shaft supporting portion 111 in such a manner as to be movable in the axial direction thereof between a first position (see FIG. 3) where the projection 121 is in contact with one of two ends of the groove 122 that is nearer to the base of the rotational shaft portion 110 and a second position (see FIG. 4) where the projection 121 is in contact with the other end of the groove 122 that is nearer to the tip of the rotational shaft portion 110.

When the rotational shaft portion 110 is at the first position, the projecting portion 112 provided at the base of the rotational shaft portion 110 is fitted in the recessed portion 113 provided at the end 111*a* of the opening provided in the shaft supporting portion 111. Since the projecting portion 112 is fitted in the recessed portion 113, the arm part 104 is retained in a state of being stopped from rotating relative to the body part 103. When the rotational shaft portion 110 is at the second position, the projecting portion 112 is out of the recessed portion 113, allowing the arm part 104 to rotate relative to the body part 103.

Figure 5:
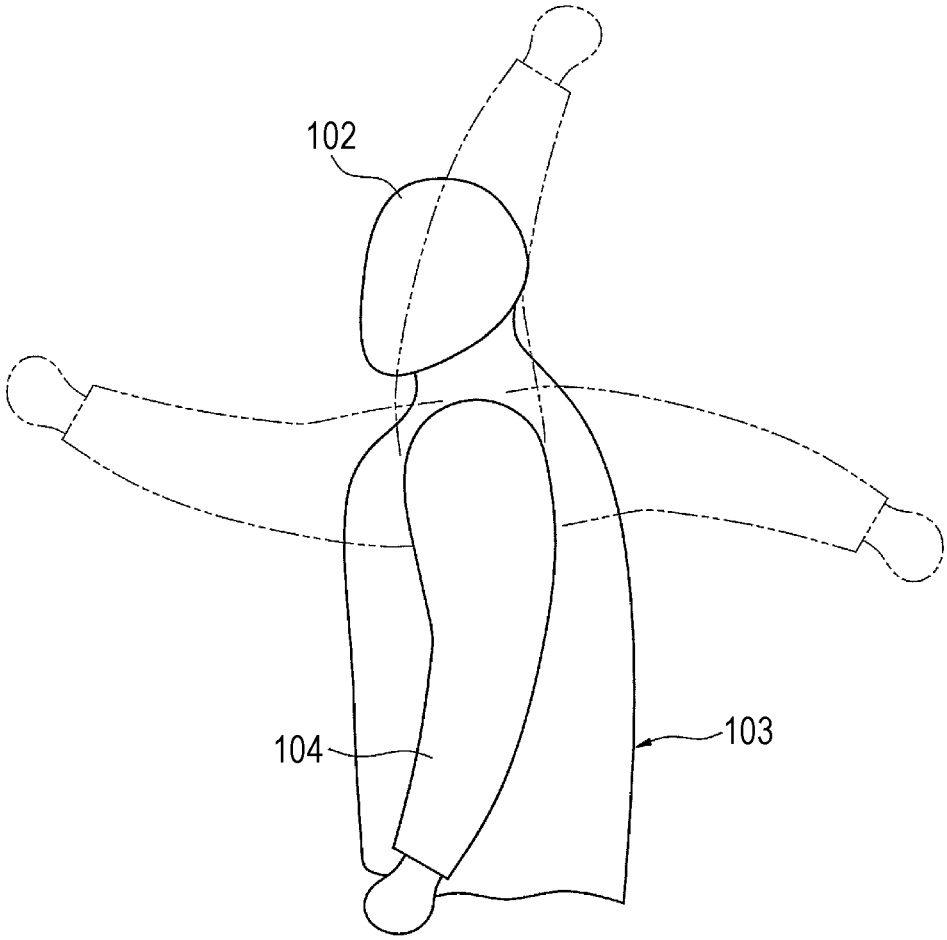
FIG. 5 illustrates how the arm part of the model illustrated in FIG. 1 is retained.

The projecting portion 112 has a square shape that is rotationally symmetrical about the center axis of the rotational shaft portion 110. The recessed portion 113 has a square shape that is rotationally symmetrical about the center axis of the shaft supporting portion 111 and is the same as that of the projecting portion 112. Hence, as illustrated in FIG. 5, the projecting portion 112 is allowed to be fitted into the recessed portion 113 every time the arm part 104 is rotated by approximately 90°. If the rotational shaft portion 110 is pushed into the shaft supporting portion 111 when the projecting portion 112 is allowed to be fitted into the recessed portion 113, the projecting portion 112 is fitted in the recessed portion 113. Thus, the arm part 104 is stopped from rotating relative to the body part 103 and is retained at that position taken after the rotation.

While the above description concerns a case where the projecting portion 112 and the recessed portion 113 each have a square contour, the projecting portion 112 and the recessed portion 113 may each have any other polygonal shape such as a hexagonal shape. If the projecting portion 112 and the recessed portion 113 each have a hexagonal shape, the position of the arm part 104 is retainable every time the arm part 104 is rotated by approximately 60°. As the number of corners of each of the projecting portion 112 and the recessed portion 113 increases, the angle of rotation by which the arm part 104 becomes retainable is reduced, that is, the number of positions where the arm part 104 becomes retainable increases. Considering the balance with the force of retaining the arm part 104, the number of corners of each of the projecting portion 112 and the recessed portion 113 is preferably four to six.

The corners 112*a* of the projecting portion 112 that each stop the rotation of the arm part 104 are chamfered or rounded off as mentioned above.

Figure 6A:
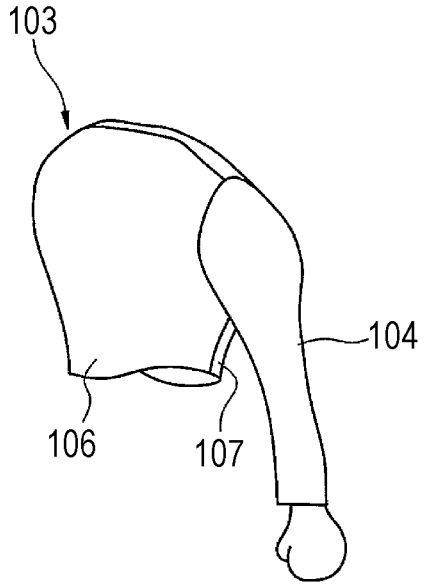
FIGS. 6A to 6D illustrate a behavior of the arm part of the model illustrated in FIG. 1 that is exhibited when the arm part is rotated.
Figure 6B:
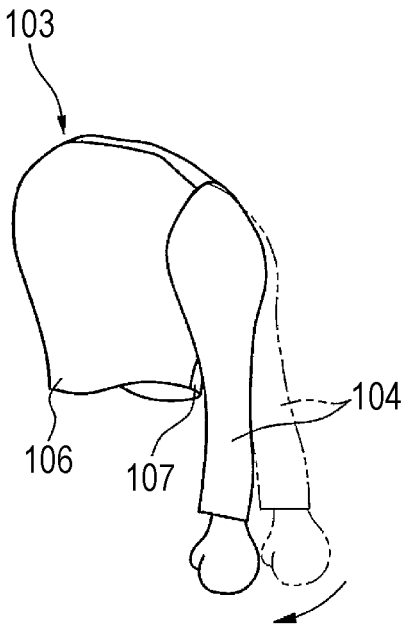
Figure 6C:
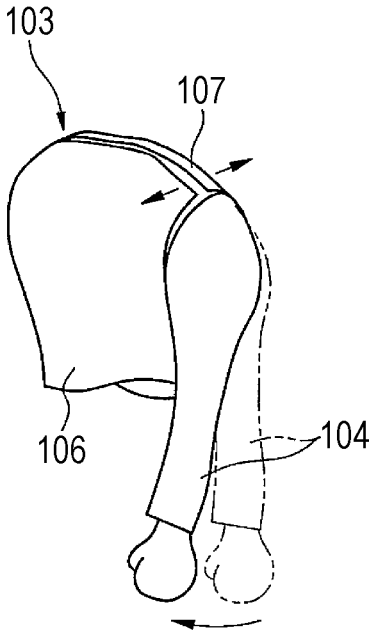
Figure 6D:
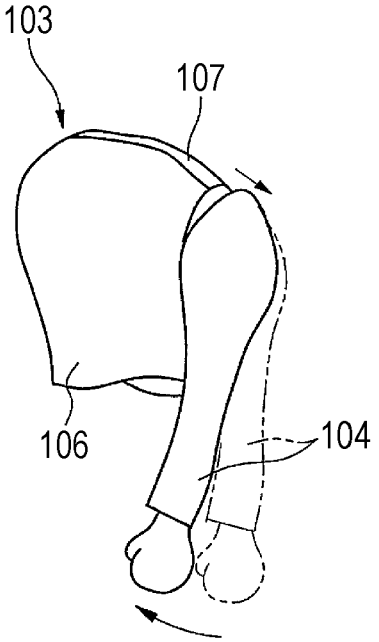
Figure 7:
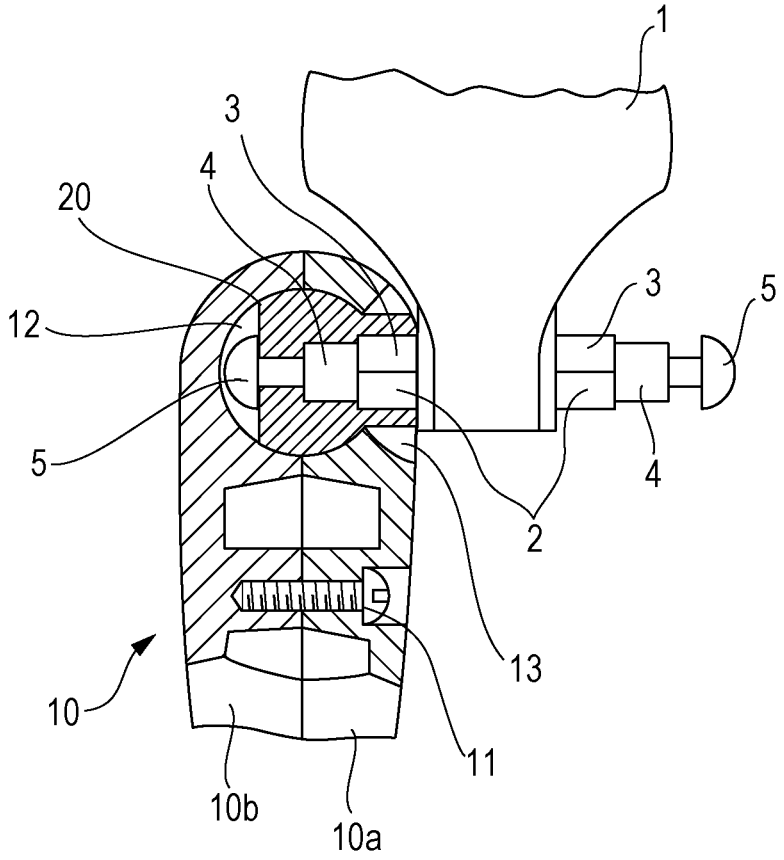
FIG. 7 illustrates a known model.

In a state illustrated in FIG. 6A where the projecting portion 112 is fitted in the recessed portion 113 and the arm part 104 is thus stopped from rotating relative to the body part 103, if the arm part 104 is pulled forcibly, the arm part 104 is rotated by a very small angle, as illustrated in FIG. 6B, corresponding to the amount of chamfering or rounding of the corners 112*a*. Triggered by this rotation, referring now to FIG. 6C, the arm part 104 is further rotated while increasing a gap between respective joined surfaces of the first member 106 and the second member 107 near the recessed portion 113. In this process, a reaction force of the first member 106 and the second member 107 is applied to the projecting portion 112. The reaction force acts to push the projecting portion 112 out of the recessed portion 113, whereby the projecting portion 112 comes out of the recessed portion 113 as illustrated in FIG. 6D. Consequently, the arm part 104 is allowed to rotate relative to the body part 103.

Chamfering or rounding of the corners 112*a* of the projecting portion 112 as described above realizes the automatic disengagement of the projecting portion 112 from the recessed portion 113 when the arm part 104 is forcibly rotated. Thus, the occurrence of any damage to the body part 103 and the arm part 104 is suppressed.

While the above embodiment concerns the connection portion of the model 101, which is a model doll, where the body part 103 and the arm part 104 are connected to each other, the above configuration is also suitably applicable to, for example, a connection portion where the body part 103 and each of the leg parts 105 are connected, and to any of other connection portions at elbows, knees, a neck, and so forth.

What is claimed is:

1. A model comprising:

a first part including a rotational shaft portion; and a second part rotatable connected to the first part, the second part including a shaft supporting portion configured to accept the rotational shaft portion, wherein the rotational shaft portion is inserted into the shaft supporting portion and supported by the shaft supporting portion in such a manner as to be rotatable and to be movable in an axial direction of the rotational shaft portion, wherein the first part includes a projecting portion provided at a base of the rotational shaft portion, wherein the projecting portion comprises a polygonal shape that is rotationally symmetrical about a center axis of the rotational shaft portion;

wherein the second part includes a recessed portion configured to engage the projecting portion provided at an end of an opening provided in the shaft supporting portion, wherein the recessed portion comprises the same polygonal shape as the projecting portion;

wherein the projecting portion and the recessed portion are positioned such that, when the rotational shaft portion is inserted to a first axial position within the shaft supporting portion, the projecting portion is engaged with the recessed portion and thereby prevents rotation of the first part relative to the second part, and when the rotational shaft portion is inserted to a second axial position within the shaft supporting portion the first part is free to rotate relative to the second part;

wherein, in the first axial position, the rotation shaft portion is positioned further within the shaft supporting portion than in the second axial position; and wherein the rotational shaft portion and the shaft supporting portion include respective locking members that are engageable with each other, the locking members limiting the movement of the rotational shaft portion in the axial direction within a range between the first axial position where the projecting portion is engaged with the recessed portion and the second axial position where the projecting portion is not engaged with the recessed portion.

2. The model according to claim 1, wherein corners of the projecting portion are chamfered or rounded off.

3. The model according to claim 1, wherein the projecting portion and the recessed portion each comprise between four and six corners.

4. The model according to claim 1, wherein the locking member of the rotational shaft portion comprises a ring-shaped groove provided along an outer circumference of the rotational shaft portion, and wherein the locking member of the shaft supporting portion is a projection that is configured to be received by the groove.

* * * * *